US007990041B2

(12) United States Patent
Carter et al.

(10) Patent No.: US 7,990,041 B2
(45) Date of Patent: Aug. 2, 2011

(54) LOW-PRESSURE MERCURY VAPOR DISCHARGE LAMP WITH AMALGAM CAPSULE HAVING AMALGAM CHAMBER

(75) Inventors: Brett Carter, Salina, KS (US); Ronald Huijben, Kruisland (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 73 days.

(21) Appl. No.: 12/598,765

(22) PCT Filed: May 5, 2008

(86) PCT No.: PCT/IB2008/051733

§ 371 (c)(1),
(2), (4) Date: Nov. 4, 2009

(87) PCT Pub. No.: WO2008/139359

PCT Pub. Date: Nov. 20, 2008

(65) Prior Publication Data

US 2010/0134000 A1 Jun. 3, 2010

Related U.S. Application Data

(60) Provisional application No. 60/916,944, filed on May 9, 2007.

(51) Int. Cl.

| | |
|---|---|
| ***H01J 61/72*** | (2006.01) |
| ***H01J 61/24*** | (2006.01) |
| ***F04B 37/02*** | (2006.01) |

(52) U.S. Cl. ..... 313/490; 313/545; 313/546; 313/564; 313/566; 417/51

(58) Field of Classification Search ..... None
See application file for complete search history.

(56) References Cited

U.S. PATENT DOCUMENTS

| | | | | |
|---|---|---|---|---|
| 4,288,715 | A | 9/1981 | van Overveld et al. | |
| 4,393,325 | A * | 7/1983 | van der Kooi | 313/552 |
| 6,456,004 | B1 | 9/2002 | Johnson et al. | |
| 6,906,460 | B2 * | 6/2005 | Busai et al. | 313/565 |
| 2001/0030506 | A1 * | 10/2001 | Lankhorst et al. | 313/490 |

FOREIGN PATENT DOCUMENTS

| | | | |
|---|---|---|---|
| EP | 0063393 | A1 | 10/1982 |
| WO | 9602936 | A1 | 2/1996 |
| WO | 2004112085 | A2 | 12/2004 |
| WO | 2006000974 | A2 | 1/2006 |

* cited by examiner

*Primary Examiner* — Ashok Patel

(57) ABSTRACT

An amalgam capsule (16) for a low-pressure mercury vapor discharge lamp (1) has a closed end and an opposing end with an opening (21) to allow passage of mercury vapor between the amalgam plug (18) and the discharge space (3) of the lamp (1). A glass rod (19) placed in the capsule (16) restrains movement of the amalgam plug (18), and projections (20) in the inner wall of the capsule (16) restrain movement of the glass rod (19). The presence of the amalgam capsule (16) in the discharge space (3) enables highly-loaded, substantially temperature-independent operation of linear fluorescent lamps such as T8 lamps.

22 Claims, 3 Drawing Sheets

LOW-PRESSURE MERCURY VAPOR DISCHARGE LAMP WITH AMALGAM CAPSULE HAVING AMALGAM CHAMBER

BACKGROUND OF THE INVENTION

This invention relates to low-pressure mercury vapor discharge lamps, and more particularly relates to such lamps which utilize amalgam to achieve a measure of temperature-independent operation.

Low-pressure mercury vapor discharge lamps, commonly referred to as fluorescent lamps, generally take the form of a sealed glass tube containing electrodes, mercury (Hg) and an inert gas, and internally coated with a phosphor layer.

The electrodes provide an electrical interface between external power and an internal plasma that forms between the electrodes during lamp operation. The mercury vapor absorbs electrical energy and emits UV radiation, while the phosphor layer absorbs UV radiation emitted by the mercury and emits longer wavelength UV radiation and/or visible light, depending on the particular type of lamp and its intended application.

The mercury vapor pressure is key to the efficient operation of such a fluorescent lamp. If too little mercury vapor exists in the plasma discharge, little UV radiation will be produced, and if too much mercury vapor exists in the plasma discharge, some of the UV radiation will get reabsorbed by the excess mercury vapor, reducing light output and causing inefficient power usage.

A common technique for control of the mercury vapor pressure in the discharge space is to design the lamp with a cold spot to which excess mercury vapor can condense, so that an equilibrium is established between the condensed mercury and the mercury vapor. Unfortunately, this technique is only useful over a relatively narrow temperature range. When the temperature in the discharge vessel increases much above this temperature range, for example, because the ambient temperature increases, the output efficiency decreases.

Another well-known method for control of the mercury vapor pressure involves the use of a mercury amalgam. This method allows the lamp to operate efficiently at a wider range of temperatures than standard fluorescent lamps employing cold spot technology. This method is commonly used in compact fluorescent lamps, but rarely used in linear or U-bent fluorescent lamps.

Using amalgams in fluorescent lamps requires methods which ensure against loss of mercury to the environment during handling and storage; which ensure that the amalgam stays in the proper location during lamp processing and operation; and which is compatible with high speed fluorescent lamp equipment and processes while also being cost effective. If sealed amalgam capsules are used, then the method must include the step of opening the capsule in the finished sealed lamp. See in this regard U.S. Pat. No. 4,288,715 and EP 0 063 393.

International Patent Application Publication WO 2006/000974 A2, the entire specification of which is incorporated by reference herein, discloses a low-pressure mercury vapor discharge lamp employing an amalgam to control mercury vapor pressure. The lamp is said to offer a compact design by locating the amalgam in a glass capsule (12) mounted inside the tubular glass vessel (2) which encloses the discharge space (3). The capsule (12) encloses an amount of amalgam (13) and has a gas opening at one end to enable gas exchange between the amalgam (13) and the discharge space (3). A glass rod (15) is located between the amalgam (13) and the gas opening (14) to prevent the plug of amalgam (13) from escaping from the capsule (12).

A drawback of the above arrangement is that the rod is not secured in the capsule and thus can move during lamp processing and/or operation, enabling the amalgam to move relative to its optimal location in the lamp, and even allowing portions of the amalgam to escape from the capsule.

According to the invention, a low-pressure mercury vapor discharge lamp comprises a glass vessel enclosing a discharge space containing mercury and an inert gas, the glass vessel being provided with at least one glass stem located within an end portion of the glass vessel, and also comprises a container encapsulating at least one plug of amalgam, the container being provided with an opening enabling gas exchange between the amalgam and the discharge space, the container also being provided with at least one spacer located between the amalgam and the opening to restrain movement of the amalgam within the container, the lamp being characterized in that the container also includes means for restraining the movement of the spacer within the container.

For the sake of convenience, the term 'amalgam' as used herein means both an amalgam of mercury with one or more other metals or alloys, as well as the pre-amalgam metal(s) or alloy(s) which may initially reside in the container or capsule, and which become amalgamated with mercury during subsequent lamp start-up and/or operation. Starting with a pre-amalgam metal or alloy in the capsule eliminates the potential loss of mercury during storage, handling and lamp manufacture. Mercury is then introduced into the lamp separately, in any of several known ways.

Suitable amalgam-forming metals and alloys are well-known, and include for example, indium, bismuth-indium alloys, and silver, lead, tin and their alloys.

The capsule is mounted inside the discharge space of the lamp, for instance, to an electrode shield or a metal collar easily attached (e.g., by welding) to an inner lead wire or an existing auxiliary wire of the lamp. The capsule, via its location and distance from the electrode, sets the operating temperature of the amalgam and constrains its movement at lamp operating temperatures.

Suitable means for restraining the spacer(s) in the capsule include metal wires and projections or annular ridges on the inner wall of the capsule. Suitable spacers include rod(s) and/or tube(s) of a heat-resistant glass, such as quartz or borosilicate glass.

According to a preferred embodiment of the invention, the capsule contains a main amalgam plug near the closed end of the capsule, an auxiliary amalgam plug near the opening in the capsule, a first spacer located between the main amalgam plug and the auxiliary amalgam plug, and a second spacer located between the auxiliary amalgam plug and the opening in the capsule.

According to another preferred embodiment of the invention, the amalgam capsule contains a magnetic plug in addition to the amalgam plug, and the amalgam capsule is moveably mounted inside a larger capsule having a fixed position within the discharge space, so that the amalgam capsule can be moved by means of an external magnet after lamp sealing has taken place, enabling adjustments to the location of the amalgam capsule to compensate for varying internal and/or external conditions.

The invention is usefully embodied, for example, in highly loaded substantially temperature-independent linear fluorescent lamps such as those having tubular envelopes of the type "T8", efficiently operable over a temperature range of about 20 to 150 degrees F. at a power rating of about 80 to 85 W, compared to a temperature range of about 32 to 77 degrees F. and a power rating of about 25-40 W for standard T8 lamps without amalgam.

The invention is compatible with modern high speed horizontal lamp-making equipment, and can be readily integrated into existing manufacturing technologies for linear fluorescent lamps such as the T8 lamp.

BRIEF DESCRIPTION OF THE DRAWINGS

These and other aspects of the invention will be further elucidated with reference to the Figures, in which.

The Figures are diagrammatic and not drawn to scale. The same reference numbers in different Figures refer to like parts.

DETAILED DESCRIPTION OF THE PREFERRED EMBODIMENTS

Figure 1:
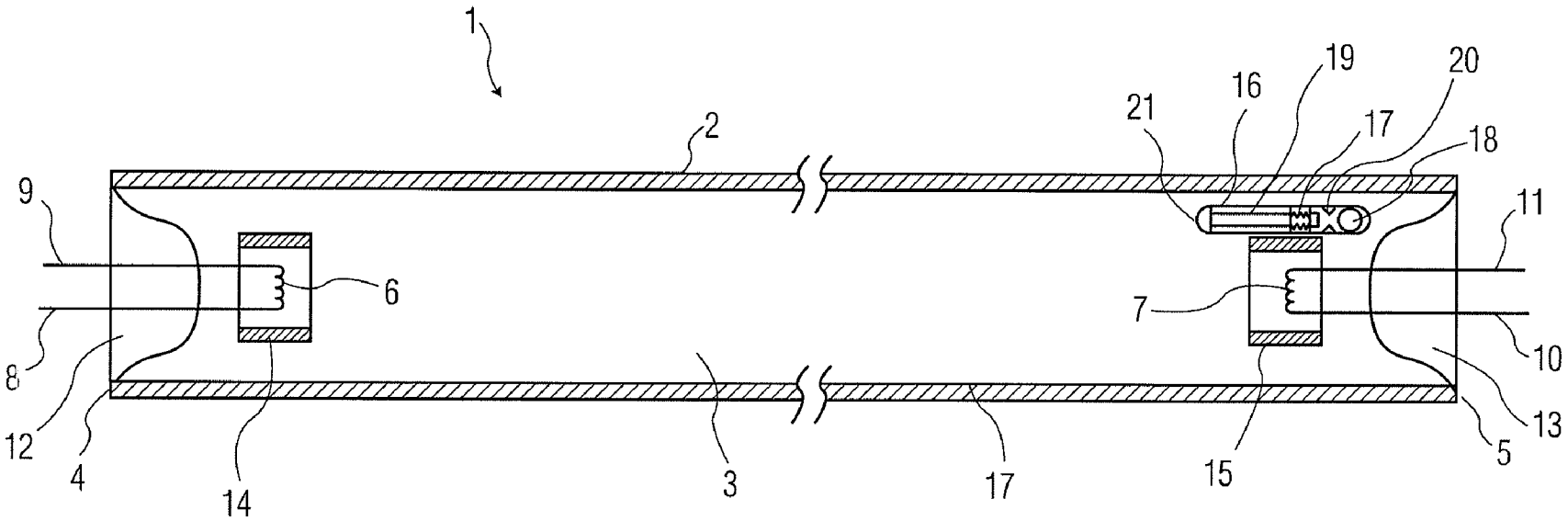
FIG. 1 shows a low-pressure mercury vapor discharge lamp having an amalgam capsule with retaining means according to one embodiment of the invention.

FIG. 1 shows a schematic view of a low-pressure mercury vapor discharge lamp 1 according to the invention, having a straight elongate tubular glass vessel 2 of the type generally know as a TL-lamp, which encloses a discharge space 3 which is filled with a gas mixture of an inert gas such as argon, and mercury (mercury) vapor. The glass vessel has two distal ends 4 and 5 provided with electrodes 6 and 7 mounted on conductors 8 and 9, and 10 and 11, respectively. The conductors (8, 9, 10, 11) pass through gas-tight press seals 12 and 13, formed in the ends of the vessel 2 from tubular glass stems, after the discharge space 3 is filled with the gas mixture, in the known manner. The portions of the conductors which extend outside the discharge space form contact pins for the supply of electrical power to the electrodes 6 and 7. The electrodes 6 and 7 are surrounded by metal shields 14 and 15, which have the function of reducing end darkening during lamp operation and also serve as a convenient mounting location for capsules.

A glass capsule 16 is mounted on shield 15 by a mounting member 17. The glass capsule 16 has a closed end and an open end with an opening 21. A quantity of amalgam 18, for instance a bismuth-indium amalgam. is situated near the closed end of the capsule 16 and a glass rod 19 is located between the amalgam 18 and the open end of the capsule 16 to restrain movement of the amalgam 18. The glass rod has a diameter smaller than the inside diameter of the capsule, enabling mercury vapor to pass between the amalgam 18 and the discharge space 3 via the opening 21.

In accordance with the invention, restraining means in the form of protrusions 20 from the inner wall of the glass capsule 16 are provided to restrain movement of the glass rod 19 in the capsule 16. Protrusions 20 may take the form of one or more raised portions or a continuous annular ridge or any other form which will serve to restrain movement of the glass rod 19.

The location of the capsule is determined by the desired distance between the electrode 7 and the amalgam 18 to result in optimal performance of the lamp.

Figure 2:
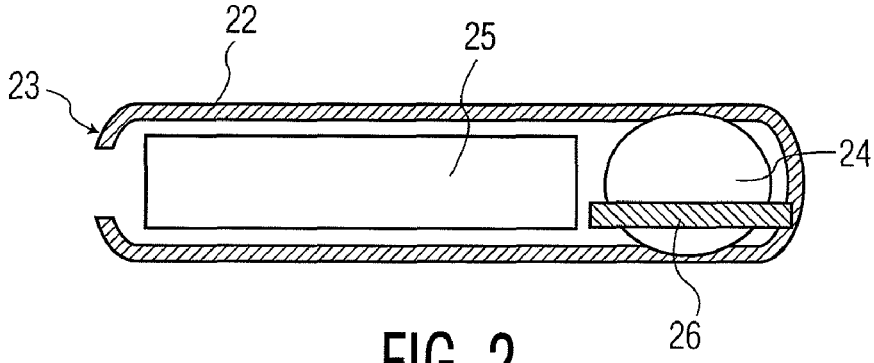
FIG. 2 shows an amalgam capsule with retaining means according to a second embodiment of the invention.

FIG. 2 shows a second embodiment of the amalgam capsule for use in the fluorescent lamp of the invention. Capsule 22 has an open end 23, an amalgam plug 24 located near the opposite, closed end of the capsule 22, a glass rod 25 and short length of wire 26 for restraining movement of the glass rod 25.

Exemplary of this embodiment is a capsule 22 made of borosilicate capillary glass tube having an ID of 2 mm and an OD of 2.4 mm, a quartz rod 25 having a diameter of 1.5 mm, and a 0.014-0.015 gauge stainless steel wire, 4-8 mm in length. One end of the capillary glass tube is sealed by heating, after which the wire 26 is inserted. Small balls (or short pieces of wire) of indium metal or bismuth-indium alloy 1.4-1.5 mm in diameter are next added to the tube near its sealed end. The sealed end is then heated with a hot air gun to melt the balls or wire pieces into a plug 24 surrounding the stainless steel wire. Next the quartz rod 25 is added to the capsule to form a chamber containing the wire and the amalgam plug. The open end of the tube is then fire polished to glaze the glass and reduce the tubing diameter to a small opening, e.g., less than 1.5 mm diam., which is sufficient to allow ready passage of mercury vapor, without allowing the quartz rod to move out of the tube.

Figure 3:
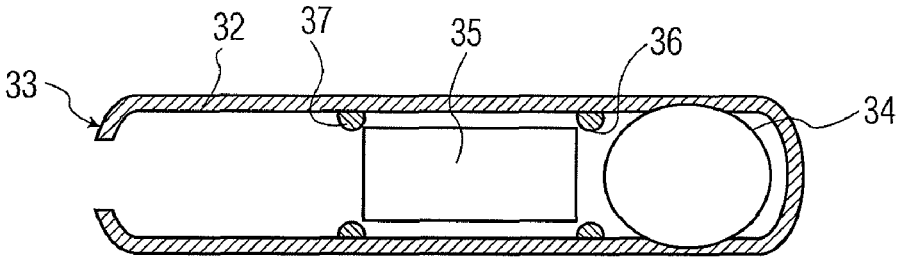
FIG. 3 shows an amalgam capsule with retaining means according to a third embodiment of the invention.

FIG. 3 shows a third embodiment of a capsule suitable for use in a lamp of the invention. Capsule 32 has an open end 33, an amalgam plug 34 located near the opposite, closed end of the capsule 32, and a glass rod 35 for restraining movement of the plug 34. In this embodiment, the wire 26 is replaced by projections 36 and 37 as the means for restraining movement of the glass rod 35.

An exemplary procedure for forming capsule 32 is similar to that described for capsule 22, except that after forming the closed end of the tube, the balls of amalgam are then added and heated to form the plug. The projections are formed by using a small burner to create indentations in the outer wall of the capsule, forming a chamber for the amalgam plug at the sealed end of the capsule.

Figure 4:
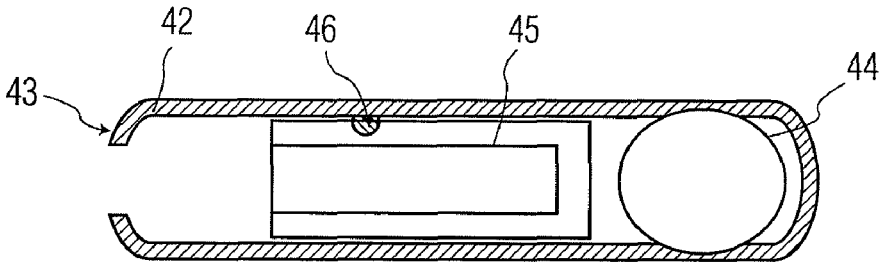
FIG. 4 shows an amalgam capsule with retaining means according to a fourth embodiment of the invention.

FIG. 4 shows a fourth embodiment of a capsule suitable for use in a lamp of the invention. Capsule 42 has an open end 43, an amalgam plug 44 located near the opposite, closed end of the capsule 42, and a glass tube 45, closed at one end, for restraining movement of the plug 44. In this embodiment, the glass tube 45 is restrained by a projection 46, which is formed by as described above.

Figure 5:
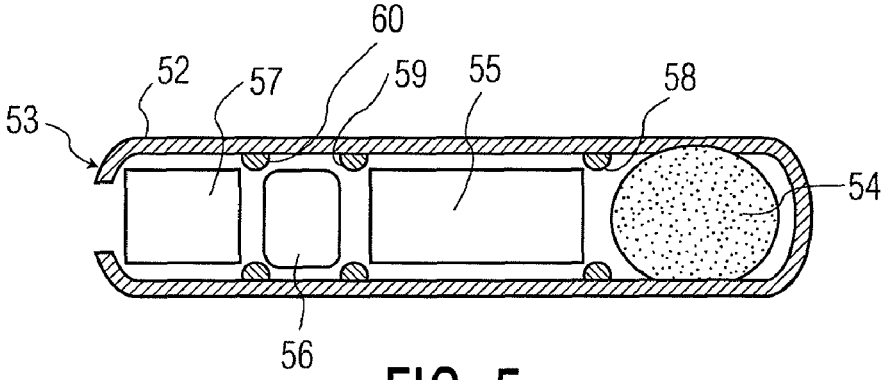
FIG. 5 shows an amalgam capsule with main and auxiliary amalgams according to a fifth embodiment of the invention.

FIG. 5 shows a fifth embodiment of a capsule suitable for use in a lamp of the invention. Capsule 52 has an open end 53, a first amalgam plug 54 located near the opposite, closed end of the capsule 52, and a second amalgam plug 56 near the open end 53 of the tube 52. A first glass rod is located between the plugs 54 and 56, while a second glass rod 56 is located between the second plug 56 and the open end 53 of the tube 52. Glass rods 55 and 57 separate the plugs 54 and 56 from one another, and also restrain movement of the plugs 54 and 56 in the capsule 52. In this embodiment, the glass rods 55 and 57 are restrained by projections 58, 59 and 60, which are formed in the same manner as the projections 36 and 37 of the third embodiment described above.

By means of the second plug 56, a secondary amalgam (auxiliary amalgam) is available to operate during lamp warm-up. The secondary amalgam quickly releases mercury to improve lamp run-up characteristics when initially lit.

The length and location of the capsule 52 in the lamp determine the locations and temperatures of the main and auxiliary amalgams during lamp operation.

Figure 6:
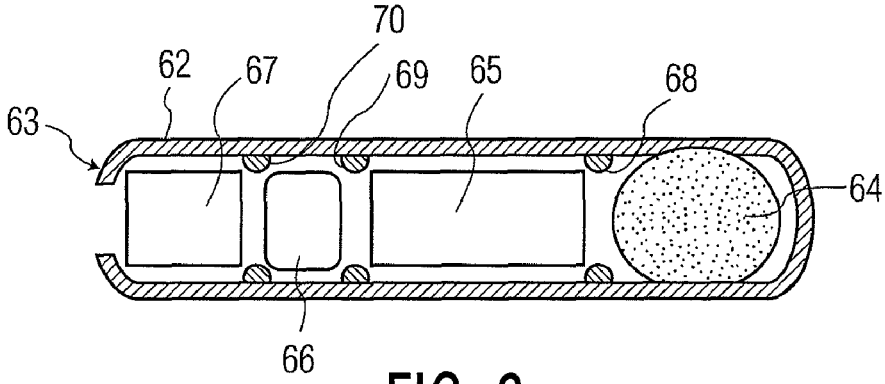
FIG. 6 shows a moveable amalgam capsule according to a sixth embodiment of the invention.
Figure 7:
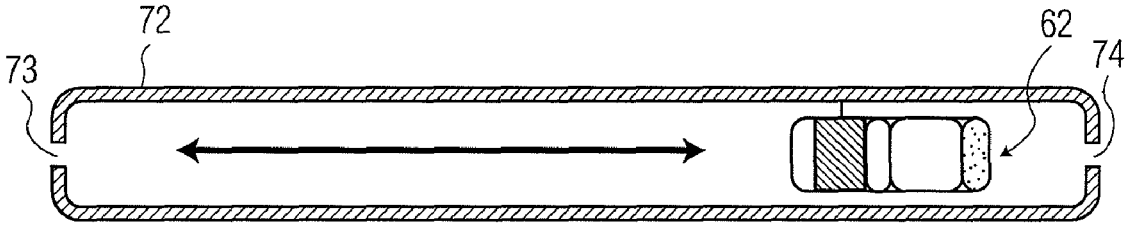
FIG. 7 shows the location of the moveable amalgam capsule of FIG. 6 in a fixed capsule according to the sixth embodiment of the invention.

FIGS. 6 and 7 show a sixth embodiment of a capsule suitable for use in a lamp of the invention. FIG. 6 shows a moveable capsule 62 having an open end 63, an amalgam plug 64 located near the opposite, closed end of the capsule 62, a magnetic plug 66 located near the open end 63, and first and second glass rods 65 and 67 separating the plugs 64 and 66 from one another and from the open end 63. Movement of the plugs 64 and 66 and the glass rods 65 and 67 is restrained by projections 68, 69 and 70.

FIG. 7 shows a second capsule 72 with open ends 73 and 74 for passage of mercury vapor. Capsule 72 is located in a fixed position within the discharge space 3 of the lamp, while the moveable capsule 62 is located within the fixed capsule 72, to allow the relocation of the amalgam plug in a finished fluorescent lamp.

The ability to relocate the position of the amalgam plug in a finished lamp enables adjustments to the distance of the plug from the proximal electrode (which changes the temperature of the plug) to optimize the mercury pressure according to varying ambient and lamp loading conditions, as well as to decreasing amounts of mercury as it is consumed over the life of the lamp, thus optimizing and/or maintaining the efficiency of lamp operation.

The amalgam plug can also be moved closer to the electrode during lamp start-up to more quickly reach a steady state, and then moved away from the electrode to an optimal location for steady-state lamp operation.

The outer glass tube 72 is mounted in the discharge space 3, for instance, by means of a non-magnetic collar attached to an inner lead wire (or auxiliary wire if available) to rigidly fix its location in the end of the lamp. The outer tube 72 is oriented so that movement of the capsule 62 along the tube moves the amalgam plug 65 closer to or further away from the proximal electrode 7. Movement of the capsule 62 is accomplished by moving an external magnet adjacent to the location of the magnetic plug 66. Based on the exemplary dimensions set forth above for the second embodiment of the capsule, the metallic plug 66 is an iron plug 1.4 mm in diameter. The ID of glass tube 72 is slightly larger than the OD of the capsule, for instance, 2.5 to 3.5 mm.

The invention has necessarily been described in terms of a limited number of embodiments. From this description, other embodiments and variations of embodiments will become apparent to those skilled in the art, and are intended to be fully encompassed within the scope of the invention and the appended claims. For example, other embodiments might use other glasses or non-magnetic metal tubing for the spacers, and chamber forming inserts as the restraining means for the spacers.

The invention claimed is:

1. A low-pressure mercury vapor discharge lamp (1) comprising a glass vessel (2) enclosing a discharge space (3), the glass vessel (2) provided with at least one glass stem (13) located within an end portion of the glass vessel (2), and also comprising a container (16) encapsulating at least one plug (18) of amalgam, the container (16) being provided with an opening (21) enabling gas exchange between the amalgam plug (18) and the discharge space (3), the container (16) also being provided with at least one spacer (19) located between the amalgam plug (18) and the opening (21), to restrain movement of the amalgam plug (18) within the container (16), the lamp (1) being characterized in that the container (16) also includes means (20) for restraining the movement of the spacer (19) within the container (16).

2. The low-pressure mercury vapor discharge lamp (1) of claim 1, in which the lamp comprises at least one electrode (7) and at least one electrode shield (15) surrounding the electrode (7), and in which the container (16) is mounted on the electrode shield (15).

3. The low-pressure mercury vapor discharge lamp (1) of claim 2, in which the container (16) is mounted on the electrode shield (15) by means of a mounting member (17).

4. The low-pressure mercury vapor discharge lamp (1) of claim 1, in which the means (20) for restraining the movement of the spacer (19) within the container (16) comprises a metal wire (26) located near the end of the container (22).

5. The low-pressure mercury vapor discharge lamp (1) of claim 1, in which the means (20) for restraining the movement of the spacer (19) within the container (16) comprises one or more projections (36, 37) in the inner wall of the container (22).

6. The low-pressure mercury vapor discharge lamp (1) of claim 1, in which the means (20) for restraining the movement of the spacer (19) within the container (16) comprises at least one projection (46) in the inner wall of the container (22).

7. The low-pressure mercury vapor discharge lamp (1) of claim 1, in which the spacer (19) comprises a glass rod (25, 35).

8. The low-pressure mercury vapor discharge lamp (1) of claim 1, in which the spacer (19) comprises a glass tube (45) closed at least at the end proximal to the amalgam plug (44).

9. The low-pressure mercury vapor discharge lamp (1) of claim 1, in which there is a main amalgam plug (54) near the closed end of the container (52), an auxilliary amalgam plug (56) near the opening (53) of the container (52), a first spacer (55) located between the main amalgam plug (54) and the auxilliary amalgam plug (56), and a second spacer (57) located between the auxilliary amalgam plug (56) and the opening (53) of the container (52).

10. The low-pressure mercury vapor discharge lamp (1) of claim 9, in which the means for restraining the first and second spacers (55, 57) comprises projections (58, 59, 60) between the first and second spacers (55, 57) and the main and auxilliary amalgam plugs (54, 56).

11. The low-pressure mercury vapor discharge lamp (1) of claim 1, in which there is an amalgam plug (64) near the closed end of the container (62), a magnetic plug (66) near the opening (63) of the container (62), a first spacer (65) located between the amalgam plug (64) and the magnetic plug (66), and a second spacer (67) located between the magnetic plug (66) and the opening (63) of the container (62).

12. The low-pressure mercury vapor discharge lamp (1) of claim 11, in which the container (62) is moveably mounted inside a larger container (72) having opposing ends with openings (73, 74), and the container (72) is mounted in a fixed location within the discharge space (3).

13. An amalgam container (16) for a low-pressure mercury vapor discharge lamp (1), the container (16) encapsulating at least one amalgam plug (18), the container (16) being provided with an opening (21) enabling gas exchange between the amalgam plug (18) and the discharge space (3) of the lamp (1), the container (16) also being provided with at least one spacer (19) located between the amalgam plug (18) and the opening (21), to restrain movement of the amalgam plug (18) within the container (16), characterized in that the container (16) also includes means (20) for restraining the movement of the spacer (19) within the container (16).

14. The container (22) of claim 13, in which the means (20) for restraining the movement of the spacer (25) within the container (22) comprises a metal wire (26) located near the end of the container (22).

15. The container (16) of claim 13, in which the means (20) for restraining the movement of the spacer (19) within the container (16) comprises one or more projections (36, 37) in the inner wall of the container (22).

16. The container (42) of claim 13, in which the means (20) for restraining the movement of the spacer (45) within the container (42) comprises at least one projection (46) in the inner wall of the container (42).

17. The container (16) of claim 13, in which the spacer (19) comprises a glass rod (25, 35).

18. The container (42) of claim 13, in which the spacer (19) comprises a glass tube (45) closed at least at the end proximal to the amalgam plug (44).

19. The container (52) of claim 13, in which there is a main amalgam plug (54) near the closed end of the container (52), an auxilliary amalgam plug (56) near the opening (53) of the container (52), a first spacer (55) located between the main amalgam plug (54) and the auxilliary amalgam plug (56), and a second spacer (57) located between the auxilliary amalgam plug (56) and the opening (53) of the container (52).

20. The container (52) of claim 13, in which the means for restraining the first and second spacers (55, 57) comprises projections (58, 59, 60) between the first and second spacers (55, 57) and the main and auxilliary amalgam plugs (54, 56).

21. The container (62) of claim 13, in which there is an amalgam plug (64) near the closed end of the container (62), a magnetic plug (66) near the opening (63) of the container (62), a first spacer (65) located between the amalgam plug (64) and the magnetic plug (66), and a second spacer (67) located between the magnetic plug (66) and the opening (63) of the container (62).

22. The container (62) of claim 21, in which the container (62) is moveably mounted inside a larger container (72) having opposing ends with openings (73, 74), and the container (72) is mounted in a fixed location within the discharge space (3).

* * * * *